US005934972A

United States Patent [19]

Gottschald

[11] Patent Number: 5,934,972

[45] Date of Patent: Aug. 10, 1999

[54] NC GRINDING PROCESS FOR THE CIRCUMFERENTIAL EDGE AND TOP FACET OF AN OPHTHALMIC LENS

[75] Inventor: Lutz Gottschald, Meerbusch, Germany

[73] Assignee: Wernicke & Co. GmbH, Germany

[21] Appl. No.: 08/737,763

[22] PCT Filed: May 17, 1995

[86] PCT No.: PCT/EP95/01882

§ 371 Date: Nov. 19, 1996

§ 102(e) Date: Nov. 19, 1996

[87] PCT Pub. No.: WO95/32075

PCT Pub. Date: Nov. 30, 1995

[30] Foreign Application Priority Data

May 19, 1994 [DE] Germany ..... 44 17 533

[51] Int. Cl.[6] ..... B24B 49/00; B24B 51/00

[52] U.S. Cl. ..... 451/5; 451/41

[58] Field of Search ..... 451/5, 8, 9, 10, 451/11, 41, 42, 43, 28, 240, 259, 69, 285, 435; 351/177

[56] References Cited

U.S. PATENT DOCUMENTS

| | | | |
|---|---|---|---|
| 4,596,091 | 6/1986 | Daboudet et al. | 451/9 |
| 4,829,715 | 5/1989 | Langlois et al. | 451/9 |
| 4,870,784 | 10/1989 | Ramos et al. | 451/5 |
| 4,964,239 | 10/1990 | Gottschald et al. | 451/9 |
| 5,053,971 | 10/1991 | Wood et al. | 451/5 |
| 5,341,604 | 8/1994 | Wood | 451/5 |
| 5,347,762 | 9/1994 | Ryoji et al. . | |
| 5,371,974 | 12/1994 | Lecerf et al. | 451/9 |
| 5,512,004 | 4/1996 | Strope | 451/5 |
| 5,545,075 | 8/1996 | Gottschald | 451/42 |
| 5,577,950 | 11/1996 | Smith et al. | 451/42 |
| 5,630,746 | 5/1997 | Gottschald et al. | 451/5 |

FOREIGN PATENT DOCUMENTS

| | | |
|---|---|---|
| 0092364 | 10/1983 | European Pat. Off. . |
| 0433114 | 6/1991 | European Pat. Off. . |
| 3410040 | 9/1984 | Germany . |
| 8608291 | 6/1986 | Germany . |
| 3842601 | 7/1990 | Germany . |

OTHER PUBLICATIONS

Patent Abstracts of Japan vol. 017 No. 651 (M–1519), Dec. 3, 1993.

JP,A,05 212661 (Nidek Co Ltd) Aug. 24, 1993 siehe Zusammenfassung.

*Primary Examiner*—David A. Scherbel
*Assistant Examiner*—Derris Holt Banks
*Attorney, Agent, or Firm*—Ostrolenk, Faber, Gerb & Soffen, LLP

[57] ABSTRACT

A method for N-C controlled grinding of the top facet of an ophthalmic lens comprising: determining the length of a circumference of an apex of a facet groove in a lens mount which will receive the lens, determining the length of the circumference of the apex of the top facet in the vicinity of the circumferential edge which is to be installed in the lens mount, comparing those lengths and determining whether the deviation in the length of the facet groove from the length of the top facet is within a preset limit. If it is not within the limit, changing the position of the Lop facet to be within the limit, determining a change value and then finish grinding the top facet using values selected from the comparison value or the change value. The data concerning the shape of the lens mount and of the optometric data of the lens wearer may be entered in the computer

18 Claims, 1 Drawing Sheet

NC GRINDING PROCESS FOR THE CIRCUMFERENTIAL EDGE AND TOP FACET OF AN OPHTHALMIC LENS

BACKGROUND OF THE INVENTION

The invention relates to a method for NC-controlled grinding of the circumferential edge and top facet of an ophthalmic lens in accordance with the shape of a selected lens mount and the personal optometric data of the lens wearer.

For aesthetic reasons, the top facet on the circumferential edge of a finished ophthalmic lens should have the same distance from the leading edge of the lens all around the circumference of the lens, even if the ophthalmic lens has a shape that differs sharply from the circular.

If the front of the ophthalmic lens is purely spherical, a top facet made with a constant distance from the leading edge of the ophthalmic lens also lies on a spherical surface with the same midpoint as the spherical surface of the front surface of the ophthalmic lens. If an ophthalmic lens is produced by copy grinding according to a pattern disk corresponding to the lens mount, a constant distance of the top facet from the front surface of the ophthalmic lens can be achieved either by resting a feeler on the front surface of the lens mount and controlling the relative displacement of a grinding wheel relative to the ophthalmic lens in the axial direction, or by producing the axial displacement by means of a so-called Panhard rod, whose length corresponds to the radius of the spherical front surface of the ophthalmic lens less the distance of the top facet from the leading edge of the ophthalmic lens.

In NC-controlled grinding of the circumferential edge and top facet of an ophthalmic lens, the shape of the ophthalmic lens and the personal optometric data of the ophthalmic lens wearer are available in the form of a volume of data by which the ophthalmic lens edge grinding machine can be controlled in such fashion that an ophthalmic lens blank is ground in accordance with the shape of the selected lens mount and the top facet is placed on the circumferential edge of the ground ophthalmic lens in such fashion that it extends around the entire circumference at the circumferential edge and/or maintains a certain distance from the leading edge of the ground ophthalmic lens.

In order to acquire the data relating to the shape of the lens mount, it is known that the lens mount can be placed in a device for scanning the facet groove and recording the data in three-dimensional form. It should be noted in this regard that the facet groove in a lens mount, as a result of manufacturing tolerances or deviations in shape, need not necessarily lie on a spherical surface.

A device for three-dimensional scanning of lens mounts is described in German Utility Model G8608291.4 of the Applicant.

In German Offenlegungsschrift 3410040 an NC-controlled ophthalmic lens edge grinding machine is also described. The outer and inner surfaces of an ophthalmic lens blank which is clamped in the ophthalmic lens edge grinding machine are scanned on a curve that matches the shape of the ophthalmic lens. Two spring-mounted rod-shaped feelers constantly rest directly on the glass and their axial position is fed to potentiometers the values and data collected by these potentiometers are transmitted to a computer or a data storage device that uses them to calculate the spatial pattern of the leading and trailing edges of the ophthalmic lens as well as the respective thickness of the glass. From a stored volume of data on different top facets, the computer selects the top facet that can be provided on the circumferential edge of the finished ophthalmic lens without leaving the circumferential edge at any point.

When an ophthalmic lens is measured using this method or a method described in German Patent 3842601 of the Applicant, in which the leading and trailing edges of a pre-ground ophthalmic lens are measured by a scanning head, deviations of the ophthalmic lens from the spherical shape enter into the measurement. Such deviations can result from prismatic or cylindrical grinding superimposed on spherical grinding and also from the location of a near portion. In addition, the decentration of the optical axis of the ophthalmic lens relative to the geometric axis of the ophthalmic lens or the geometric midpoint of the lens mount plays a role.

When an ophthalmic lens ground under NC-control on the basis of information from a device for scanning the facet groove of a lens mount, and the corresponding top facet is then subjected to final grinding, a computer check must be performed to determine whether a path of the top facet, determined in accordance with the measured facet groove, runs along the entire circumferential edge of the finished ophthalmic lens. This especially must take into account the fact that the top facet is intended to be located, everywhere if possible, at a constant predeterminable distance from the leading edge of the ground ophthalmic lens.

It has now been found that an ophthalmic lens ground under these assumptions and provided with a top facet cannot always be simply fitted into the selected lens mount. This requires a finishing of the ophthalmic lens that is time-consuming and requires a certain degree of skill.

SUMMARY OF THE INVENTION

The object of the invention is to provide a method for NC-controlled grinding of the circumferential edge and top facet of an ophthalmic lens, with which ophthalmic lenses, intended for a certain lens mount and produced in accordance with the personal optometric data of the lens wearer, can be inserted into the selected lens mount without having to finish the lens.

On the basis of this statement of the object, a method is hereby proposed that includes, according to the invention, of the following steps:

- determination of the length of the circumference of the facet groove apex of a selected lens mount;
- determination of the length of the circumference of the apex of a top facet that extends in the circumferential edge of an ophthalmic lens intended for this lens mount and has been or will be machined in accordance with the personal optometric data of the lens wearer;
- comparison of the length of the facet groove with that of the top facet;
- if necessary, changing the position and/or the path of the top facet at the circumferential edge of the ophthalmic lens such that the deviation of the length of the facet groove from that of the top facet lies within predetermined admissible limits; and
- finishing of the top facet with values that result from the comparison and have been changed if necessary.

The invention takes its departure from the fact that the personal optometric data of the lens wearer require a path of the top facet that need not correspond to the path of the facet groove of a selected lens mount, although the ground ophthalmic lens exactly matches the shape of the lens mount, and that an ophthalmic lens with a top facet that differs from the facet groove can nevertheless be fitted into the lens mount without difficulty if the length of the top facet corresponds to the length of the facet groove of the selected lens mount. This determination is based on the fact that a lens mount, because of its deformability, can be fitted comparatively easily to a path of a top facet of a ground ophthalmic lens that differs from the path of the facet groove, and that problems with adaptation can arise if the length of the top facet does not match the length of the facet groove.

According to the invention, the length of the facet groove of the lens mount and the length of the top facet of the ophthalmic lens are compared with one another if necessary, the position and/or the path of the top facet on the circumferential edge of the ophthalmic lens are changed in such fashion that the deviation of the length of the facet groove from that of the top facet lies within predetermined admissible limits, but without the shape or dimensions of the ground ophthalmic lens being changed, by a simple process that can be programmed into the NC-control of the ophthalmic lens edge grinding machine, the ground ophthalmic lens can be fitted without finishing into the selected lens mount.

The length of the circumference of the facet groove apex of a selected lens mount can be determined by means of a displacement measuring device, but the facet groove of a selected lens mount is preferably measured three-dimensionally by means of a scanning device and the length of the circumference of the facet groove apex is calculated from the measured data. For example if the measured data are available in the form of polar coordinates for the radial circumferential path and in the form of additional coordinates in the axial direction of the ophthalmic lens, a clear mathematical relationship exists between the angle, the radius, and the axial coordinates of the spatial curve of the facet groove apex, by means of which the length of the facet groove can be calculated using a suitable algorithm.

Similarly, the computer in our NC-controlled ophthalmic lens edge grinding machine can calculate the length of the circumference of the apex of the top facet that runs in the vicinity of the circumferential edge of the ophthalmic lens from the shape data of a selected lens mount and the personal optometric data of the lens wearer. This calculation can be performed with the knowledge that the facet is intended to be at a uniform distance everywhere from the leading edge of the circumferential edge of the ophthalmic lens.

If a comparison of the length of the facet groove with that of the top facet indicates that the deviation exceeds a predetermined limiting value, the adaptation of the length of the top facet to that of the facet groove can be accomplished by changing the distance of the top facet from the leading edge of the circumferential edge of the ophthalmic lens and/or the radius and/or the midpoint of a spherical surface that runs through the top facet.

When the distance of the top facet from the leading edge of the circumferential edge of the ophthalmic lens is changed, it is possible in extreme cases to change this distance periodically between a minimum value and a maximum value so that the top facet runs sinusoidally, so that if it should become necessary, a very great difference in length can be compensated.

In order to determine the length of the top facet, the front and rear of an ophthalmic lens blank can be scanned in accordance with the pattern of the circumferential edge of the ophthalmic lens to be ground to determine its spatial curve and the thickness of the glass, a suitable top facet is selected, the length of this top facet is compared with the length of the facet groove, and the position and/or the path of the top facet is/are changed if necessary.

Preferably, however, the front and rear of an ophthalmic lens whose shape has been preground are scanned along the edges to determine the spatial curves and the thickness of the glass, a suitable top facet is selected, the length of this top facet is compared with the length of the facet groove, and the position and/or the path of the top facet is/are changed if necessary.

The accuracy of ophthalmic lenses produced by the method according to the invention can be increased further if the radius of a predeterminable associated angle of at least one point on the apex of the top facet of the ground ophthalmic lens is measured with respect to a support, the measured value is entered into a computer, compared with a stored set value, and, in the case of a deviation of the actual value from the set value that is permissible and can be entered into the computer, an additional grinding of the circumferential contour with a radius correction corresponding to the deviation is performed.

Preferably the radius of at least one circumferential point of a top facet of the ground ophthalmic lens is measured relative to a keyway in the support, whereupon it becomes evident that the angle of the top facet is still within the range of admissible values. In this case, additional grinding of the circumferential contour with a radius correction corresponding to the deviation can produce an ophthalmic lens that is still usable.

If the angle of the top facet of the circumferential contour ground ophthalmic lens is larger than the angle of the keyway, this means that the grinding wheel used to grind the top facet must be straightened or has become unusable. This is indicated by the machine, which delivers an appropriate signal.

If the radius of at least one circumferential point on the top facet of the ground ophthalmic lens is measured both with respect to the keyway in the support and also with respect to a flat area of the support, a determination can be made by comparing these measured values as to whether a radius correction of the deviation of the actual value from the set value measured with respect to the keyway is still possible or whether the ophthalmic lens must be finished using a new or straightened grinding wheel.

If only one circumferential point is measured, the radius correction of the entire circumferential contour is performed in accordance with the deviation measured at this point. If this deviation is only the result of a wearing of the pregrinding wheel or the final grinding wheel, which as a result occurs uniformly at the circumference, with this radius correction a sufficiently accurate ground ophthalmic lens can be produced that is sufficiently accurate to be inserted directly into a specific lens mount.

Since the deviations at the circumferential contour can be of different magnitudes, with these deviations being determined by the shape of the ophthalmic lens and the spatial curve of the circumferential contour, a greater accuracy of the correction grinding process can be achieved if the entire circumferential contour is measured, compared with the stored set values, and, in the event the admissible deviation of the actual values from the set values that can be entered into the computer has been exceeded, a report on the measured deviations is produced by the computer and the additional grinding process for the circumferential contour is perform ed with a radius correction corresponding to the values determined.

In all cases, corrective grinding is performed to keep the actual magnitude of the circumferential values at 0:0.3 mm relative to the set values.

An even more precise correction of the circumferential contour can be achieved if the entire circumferential contour is measured, compared with the stored set values, and, in the event of an areawise exceeding of the admissible deviation of the actual value from the set values that can be entered into the computer, the additional grinding process with corresponding radius corrections is performed only in those areas of the circumferential contour that have an inadmissible deviation.

In order not to lose too much time when measuring the entire circumferential contour of a ground ophthalmic lens, this measurement can be performed at a rotational speed of the ophthalmic lens holding shaft that is higher than that used in the grinding process.

A suitable measuring device is described in PCT Patent Application PCT/EP 94/01945 of the same Applicant, whose disclosure content can be used to supplement the disclosure content of this application.

BRIEF DESCRIPTION OF THE DRAWINGS

The invention will now be described in greater detail with reference to the attached drawings.

DESCRIPTION OF A PREFERRED EMBODIMENT

Starting with a circular ophthalmic lens blank 1, an ophthalmic lens 2 is to be manufactured. Its shape is obtained for example by scanning a selected lens mount by means of a scanning device in accordance with German Utility Model G8608291.4 of the Applicant. The shape of ophthalmic lens 2 is then available in digital form as a three-dimensional data volume that includes the radius rho and the angle theta of the geometric midpoint of the lens mount as well as the path of the spatial curve of the facet groove of this lens mount perpendicular to the radius vector.

In view of the fact that the position of the pupil of the lens wearer as a rule differs from the geometric center of the lens mount and these decentering values are available as X and Y coordinates, ophthalmic lens blank 1 is either clamped in an ophthalmic lens edge grinding machine offset by the X and Y values or the X, Y values are calculated into the polar coordinates rho and theta of the ophthalmic lens mold and taken into account in NC-controlled grinding. An ophthalmic lens edge grinding machine like that described for example in German Offenlegungsschrift 33 16 619 can be used for the purpose.

Figure 1:
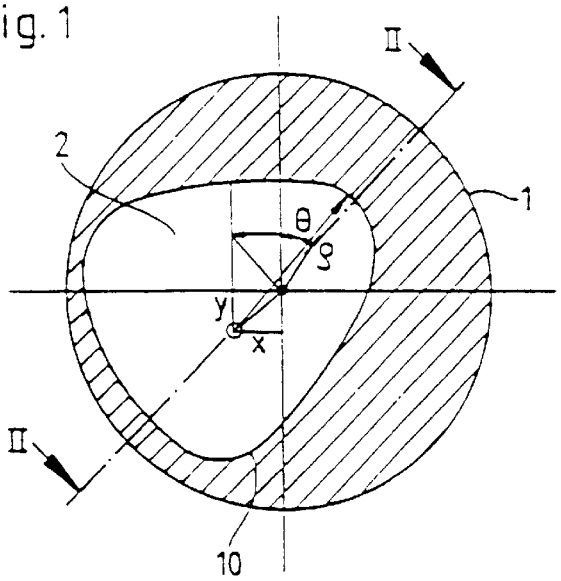
FIG. 1 is a top view of an ophthalmic lens blank and an ophthalmic lens to be produced therefrom.
Figure 2:
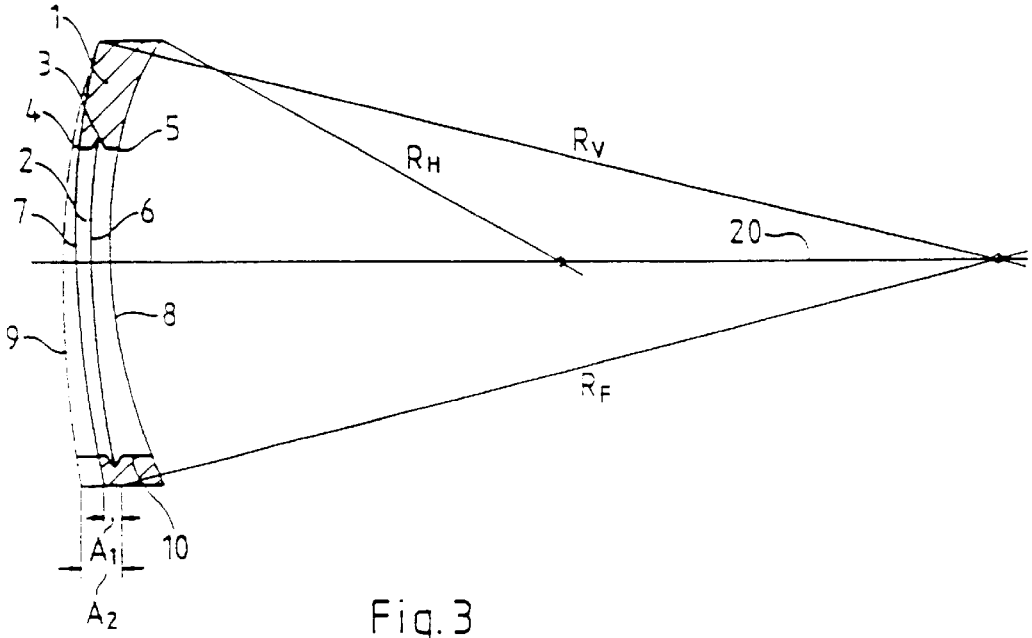
FIG. 2 is a section along line II—II in FIG. 1 showing a minus lens.

FIG. 2 is a section along line II—II in FIG. 1. The areas of circular ophthalmic lens blank 1 that are omitted during the grinding of lens 2 are shown shaded.

Ophthalmic lens blank 1 and ground ophthalmic lens 2 have a spherical front surface 7 with radius $R_y$ and a spherical rear surface 8 with radius $R_X$. The centers of these surfaces 7, 8 lie on an axis 20.

Ground ophthalmic lens 2 has a circumferential edge 10 that is delimited by a leading edge 4 and a trailing edge 5. On circumferential edge 10, a top facet 6 with an apex 3 is provided at a distance $A_1$, from leading edge 4 of ground ophthalmic lens 2 and hence from front surface 7 of ophthalmic lens blank 1. Since the front surface 7, as already mentioned, is a spherical surface, top facet 6 likewise lies on a spherical surface with radius $R_F$ that has the same midpoint as radius $R_y$. The length of this top facet 6 can be calculated exactly because of the clear relationship between the polar coordinates of circumferential edge 10 and the coordinates in the direction of optical axis 20.

If the length of this top facet 6 differs from the length, as determined by the scanning device, of the facet groove of the selected lens mount, an adaptation can be performed in which for example radius $R_f$ is reduced and/or the midpoint is displaced on optical axis 20. This is accomplished in the computer by means of a suitable program for NC-control of the ophthalmic lens edge grinding machine.

If the personal optometric data of the lens wearer require cylindrical or prismatic grinding or if the ophthalmic lens is to have a near part, additional deviations occur as shown for example by dashed front surface 9. If top facet 6 is ground in this case with a spherical radius $R_F$, the distance of the top facet in the lower area increases to distance $A_z$ so that the result is a projection of the ophthalmic lens forward beyond the lens mount, which is undesirable for aesthetic reasons. If the path of top facet 6 is changed so that it once again is at a distance $A_1$ from front face 9 that is the same everywhere, the length of top facet 6 changes and possibly no longer coincides with the length of the facet groove of the selected lens mount. In this case also, the length of the top facet can be changed by changing the radius $R_F$ of the top facet and/or the position of the midpoint on or near optical axis 20.

Figure 3:
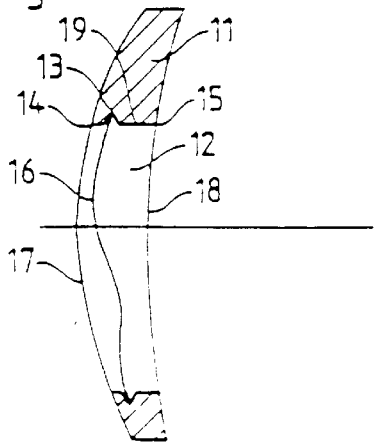
FIG. 3 is a section along line II—II in FIG. 1 showing a plus lens.

FIG. 3 shows a circular ophthalmic lens blank 11 as a plus lens, from which a ground ophthalmic lens 12 is to be produced. Ground ophthalmic lens 12 has a front surface 17 and a rear surface 18 that have a leading edge 14 and a trailing edge 15. On circumferential edge 19 of ground ophthalmic lens 12, there is a top facet 16 which is shown here with a sinusoidal path. This representation serves to illustrate the possibility of adapting the length of apex 13 of the top facet within relatively broad limits to the length of the facet groove of the selected lens mount when circumstances require.

Leading edges 4 and 14, trailing edges 5, 15, and the respective thickness of ground ophthalmic lens 2, 12 can be measured for example by means of the device of the Applicant described in German Patent 38 42 601, and a top facet 6 and/or 16 can be calculated that does not go beyond circumferential edge 10 or 19, it then being possible to correct the path of said facet in the computer in the manner indicated when the length of apex 3 or 13 of top facet 6 or 16 differs from the length of the apex of the facet groove of the selected lens mount to such a degree that a correction is necessary.

The accuracy of ophthalmic lenses 2, 12 manufactured using the method according to the invention can be increased even further when the radius of a predeterminable corresponding angle of at least one point on apex 3, 13 of top facet 6, 16 of ground ophthalmic lens 2, 12 is measured with respect to a support, the measured value is entered into a computer, compared with a stored set value, and, in the event of a deviation of the actual value from the set value that exceeds the admissible value, can be entered into the computer, and an additional grinding process for the circumferential contour is performed with a radius correction corresponding to the deviation.

If the radius of at least one circumferential point of a top facet of ground ophthalmic lens 2, 12 is measured with respect to a keyway in the support, this indicates that the angle of top facets 6, 16 still lies within the range of admissible values. In this case, by an additional grinding of the circumferential contour with a radius correction corresponding to the deviation, an ophthalmic lens 2, 12 that can still be used can be produced.

If the angle of top facets 6, 16 of circumferential contour ground ophthalmic lens 2, 12 is larger than the angle of the keyway, this means that the grinding wheel used to grind top facets 6, 16 requires straightening or has become unusable. This is indicated by the machine, which delivers an appropriate signal.

If the radius of at least one circumferential point of top facet 6, 16 of ground ophthalmic lens 2, 12 is measured with respect to both the keyway in the support and also relative to a flat area of the support, a determination can be made by comparing these measured values as to whether a radius correction of the deviation of the actual value from the set value measured relative to the keyway is still possible or whether ophthalmic lens 2, 12 must be finish-ground with a new or aligned grinding wheel.

If only one circumferential point is measured, the radius correction of the entire circumferential contour is made in accordance with the deviation determined at this point. If this deviation is merely the result of a wearing of the pregrinding wheel or the final grinding wheel, which as a rule occurs uniformly around the circumference, with this radius correction a sufficiently accurate round ophthalmic lens 2, 12 can be produced that is sufficiently accurate to be inserted directly into a given lens mount.

Since the deviations can be of different magnitudes around the circumferential contour, said deviations being determined by the shape of ophthalmic lens 2, 12 and the spatial curve of the circumferential contour, a greater accuracy of the correction grinding can be achieved if the entire circumferential contour is measured, compared with the stored set values, and, in the event the deviation of the actual values from the set values exceeds a permissible value and can be entered in the computer, a report on the measured deviations is produced by the computer and the additional grinding process for the circumferential contour is performed with a radius correction corresponding to the values determined.

In all cases, a corrective grinding is performed in order to keep the actual value of the circumferential values at 0:0.3 mm in contrast to the set values.

An even more accurate correction of the circumferential contour can be achieved if the entire circumferential contour is measured, compared with the stored set values, and, in the event of the admissible deviation of the actual value from the set values being exceeded areawise and being entered into the computer, the additional grinding process with appropriate radius corrections is performed only in those areas of the circumferential contour that show an inadmissible deviation.

In order not to lose too much time in measuring the entire circumferential contour of a ground ophthalmic lens 2, 12, this measurement can be performed at a rotational speed of the ophthalmic lens holding shaft that is higher than that used in the grinding process.

A suitable measuring device is described in PCT Patent Application PCT/EP 94/01945 of the same Applicant, whose disclosure content can be used to increase the disclosure content of this application.

Using the method according to the invention, ground ophthalmic lenses can be produced that conform to the personal optometric data of the lens wearer, have the shape of the lens mount selected by the lens wearer, and can be inserted into this selected lens mount without finishing.

I claim:

1. A method for N-C controlled grinding of the top facet of an ophthalmic lens comprising the steps of:

determining a length dimension of a circumference of an apex of a facet groove in a lens mount which is to receive the ophthalmic lens;

determining a length dimension of a circumference of an apex of a top facet in the vicinity of a circumferential edge of the ophthalmic lens which is to be installed in the lens mount;

comparing the length of the facet groove in the lens mount with the length of the top facet of the lens; determining a comparison value from the comparing step;

determining whether a deviation is within preset limits of deviation of the length of the facet groove from the length of the top facet;

if the deviation is not within the preset limits, changing the position of the top facet on the circumferential edge of the lens so that the deviation of the length of the facet groove from the length of the top facet lies within the preset limits;

determining a change value if change was performed; and finishing grinding the top facet using values selected from the comparison value or the change value.

2. The method of claim 1, further comprising machining the lens in accordance with personal optometric data of a lens wearer.

3. The method of claim 2, wherein the lens is machined before the length of the circumference of the apex of the top facet is determined.

4. The method of claim 2, wherein the lens is machined after the length of the circumference of the apex of the top facet is determined.

5. The method of claim 2, wherein data about a shape of the lens mount and personal optometric data of a lens wearer are entered into a computer of an N-C controlled ophthalmic lens edge grinding machine, and the length of the circumference of the apex of the top facet extending from the circumferential edge of the lens is calculated.

6. The method of claim 1, wherein the facet groove of the lens mount is measured three dimensionally with a scanning device, and the length of the circumference of the apex of the facet groove is calculated from that measured data.

7. The method of claim 6, wherein data about a shape of the lens mount is entered into a computer of an N-C controlled ophthalmic lens edge grinding machine, and the length of the circumference of the apex of the top facet extending from the circumferential edge of the lens is calculated.

8. The method of claim 1, wherein the length of the top facet is adapted to the length of the facet groove by changing a distance of the top facet from a leading edge of the circumferential groove of the ophthalmic lens and/or the radius and/or the position of a mid-point of a spherical surface running through the top facet.

9. The method of claim 1, wherein a front side and a rear side of an ophthalmic lens blank for the lens are scanned in accordance with a path of the circumferential edge of the lens to be ground for determining their spatial curves and a thickness of the lens, determining a position of a suitable top facet, then comparing the length of the top facet with the length of the facet groove and changing a position of the top facet.

10. The method of claim 1, wherein a front side and a rear side of an ophthalmic lens blank for the lens have been preground and scanned for spatial curves and for thickness of the lens, determining a position of a suitable top facet, then comparing the length of the top facet with the length of the facet groove and changing a position of the top facet as necessary.

11. The method of claim 1, further comprising the steps of:

mounting the lens to a support;

measuring the radius of a predeterminable corresponding angle of at least one point on the apex of the top facet of the ground lens, with respect to a support;

entering the value obtained in the measuring step into a computer;

comparing the value in the entering step with a stored value set;

and if an admissible deviation between the value in the entering step and the stored value set has been exceeded, additionally grinding the circumferential edge with a radius correction corresponding to the deviation.

12. The method of claim 11, wherein the radius of at least one circumferential point of the top facet of the ground lens is measured relative to a keyway in the support.

13. The method of claim 12, wherein the radius of at least one circumferential point of the top facet of the lens is measured both with respect to the keyway in the support and to a flat area on the support, determining by comparing the measured values whether a radius correction of the deviation of the actual value from the set value measured relative to the keyway is possible.

14. The method of claim 11, comprising measuring the entire circumferential edge of the lens to obtain a measured value and entering it into a computer;

comparing the measured value with stored set values;

and if an admissible deviation between the measured value entered into the computer and the set value is exceeded, generating a report of the measured deviation; and additionally grinding the circumferential edge of the lens with a radius correction corresponding to the values determined.

15. The method of claim 11, further comprising measuring the entire circumferential edge of the lens to obtain a measured value and entering that value into a computer;

comparing the measured value in the computer with a stored value set; and if an admissible deviation of the actual value in the computer from the value set is exceeded area wise around the lens, additionally grinding those areas of the circumferential edge of the lens that show an inadmissible deviation to provide a corresponding radius correction.

16. The method of claim 11, wherein the ground ophthalmic lens is rotated and the circumferential edge of the ground lens is measured while the lens is being rotated.

17. The method of claim 16, wherein the additional grinding step is performed with the lens rotated at a speed higher than used in the finishing grinding step for the lens.

18. A method for N-C controlled grinding of the top facet of an ophthalmic lens comprising the steps of:

determining the length of a circumference of an apex of a facet groove in a lens mount which is to receive the ophthalmic lens;

determining a length of the circumference of an apex of a top facet in the vicinity of a circumferential edge of the ophthalmic lens which is to be installed in the lens mount;

comparing the length of the facet groove in the lens mount with the length of the top facet of the lens;

determining a comparison value from the comparing step;

changing the position of the top facet on the circumferential edge of the lens so that a deviation of the length of the facet groove from the length of the top facet lies within the preset limits;

determining a change value if change was performed; and finishing grinding the top facet using values selected from the comparison value or the change value.

* * * * *